United States Patent [19]

Hannmann, Jr. et al.

[11] Patent Number: 4,515,065

[45] Date of Patent: May 7, 1985

[54] AUTOMATIC CENTERING SERVO ACTUATOR

[75] Inventors: Ralph A. Hannmann, Jr., Medford; James F. Higginbotham, Cherry Hill, both of N.J.

[73] Assignee: The United States of America as represented by the Secretary of the Navy, Washington, D.C.

[21] Appl. No.: 412,616

[22] Filed: Aug. 30, 1982

[51] Int. Cl.[3] ..... F15B 9/03

[52] U.S. Cl. ..... 91/363 A; 91/42; 91/43; 91/437; 92/13; 92/131; 92/136

[58] Field of Search ..... 60/368, 389, 390, 391, 60/468, 436, 442, 435; 91/42, 43, 361, 437, 35, 363 A, 459; 92/13, 131, 136

[56] References Cited

U.S. PATENT DOCUMENTS

| | | | |
|---|---|---|---|
| 2,381,795 | 8/1945 | Willett | 60/391 |
| 2,812,026 | 12/1957 | Braddon | 60/389 |
| 3,026,667 | 3/1962 | Nitka et al. | 60/389 |
| 3,104,589 | 9/1963 | Rudd | 91/172 |
| 3,280,558 | 10/1966 | Vetler et al. | 60/389 |
| 3,488,954 | 1/1970 | Thomas et al. | 60/390 |
| 3,608,431 | 9/1971 | Pease | 91/437 |
| 3,628,330 | 12/1971 | Miller | 60/368 |
| 4,143,584 | 3/1982 | Reneau | 91/172 |
| 4,339,984 | 7/1982 | Huhne | 91/42 |

FOREIGN PATENT DOCUMENTS

| | | | |
|---|---|---|---|
| 139505 | 10/1980 | Japan | 60/436 |

*Primary Examiner*—Robert E. Garrett
*Assistant Examiner*—Richard S. Meyer
*Attorney, Agent, or Firm*—Robert F. Beers; Henry Hansen

[57] ABSTRACT

A high resolution servo actuator is responsive to an electronic control or a manual control. An output shaft having fast response and infinite positioning for stroking a manual servo valve on a pump is rotated by hydraulic power. A set of hydraulic working cylinders and centering cylinders are connected through a rack and pinion drive to a shaft. Centering cylinders utilize stop tubes to prevent its pistons from traveling past the center position and applying a constant force to center the shaft. A directional valve controls the flow of hydraulic fluid to the working cylinders for driving the shaft throughout its range of travel. An electrohydraulic servo valve converts the electronic control signal into hydraulic flow to the actuator. Shaft position feedback is developed and connected to the electronic control.

6 Claims, 2 Drawing Figures

AUTOMATIC CENTERING SERVO ACTUATOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to electrohydraulic stroking devices and in particular to a rotary actuator for stroking a manual servo valve on a hydraulic pump.

Present actuators use an electrical stepping motor coupled with feedback potentiometers to control hydraulic pump flow. Manual control is unavailable when an electrical stepping motor actuator is utilized. Mechanical positioning of a remote control stick provides electrical signals for positioning and stepping motor and hence the actuator to a discrete number of positions. In the event electrical power is lost centering of the actuators is provided by springs. When manual centering is desired in present actuators a spring centering mechanism is utilized which normally does not result in positive centering since the springs deteriorate with use. Additionally, the centering force increases as movement from the neutral position occurs therefore affecting dynamic performance.

SUMMARY OF THE INVENTION

Accordingly, it is an object of this invention to provide a high resolution servo actuator which is capable of responding to remote electrical control signals or manual commands. Another object of the present invention is to provide a servo actuator having increased holding torque in an electronic mode. A further object of the invention is to provide an actuator having increased precise and constant centering torque throughout the rotational range at all times. Yet another object of the present invention is to provide an actuator with manual operation having an automatic brake release. Yet another object of the present invention is to provide an actuator having indefinite positioning in any mode.

Briefly, these and other objects are accomplished by a high resolution servo actuator responsive to a remote electronic control or a manual control. An output shaft having fast response and infinite positioning for stroking a manual servo valve on a hydraulic pump is rotated by hydraulic power. A set of hydraulic working cylinders and centering cylinders are connected through a rack and pinion drive to the shaft. Centering cylinders utilize stop tubes to prevent its pistons from traveling past the center position and apply a constant force to center the shaft. A directional valve controls the flow of hydraulic fluid to the working cylinders for driving the shaft throughout its range of travel. An electrohydraulic servo valve converts the electronic control signal into hydraulic flow to the actuator. Shaft position feedback is developed and connected to the electronic control.

Other objects, advantages, and novel features of the invention will become apparent from the following detailed description of the invention when considered in conjunction with the accompanying drawings.

DESCRIPTION OF THE PREFERRED EMBODIMENT

Figure 1:
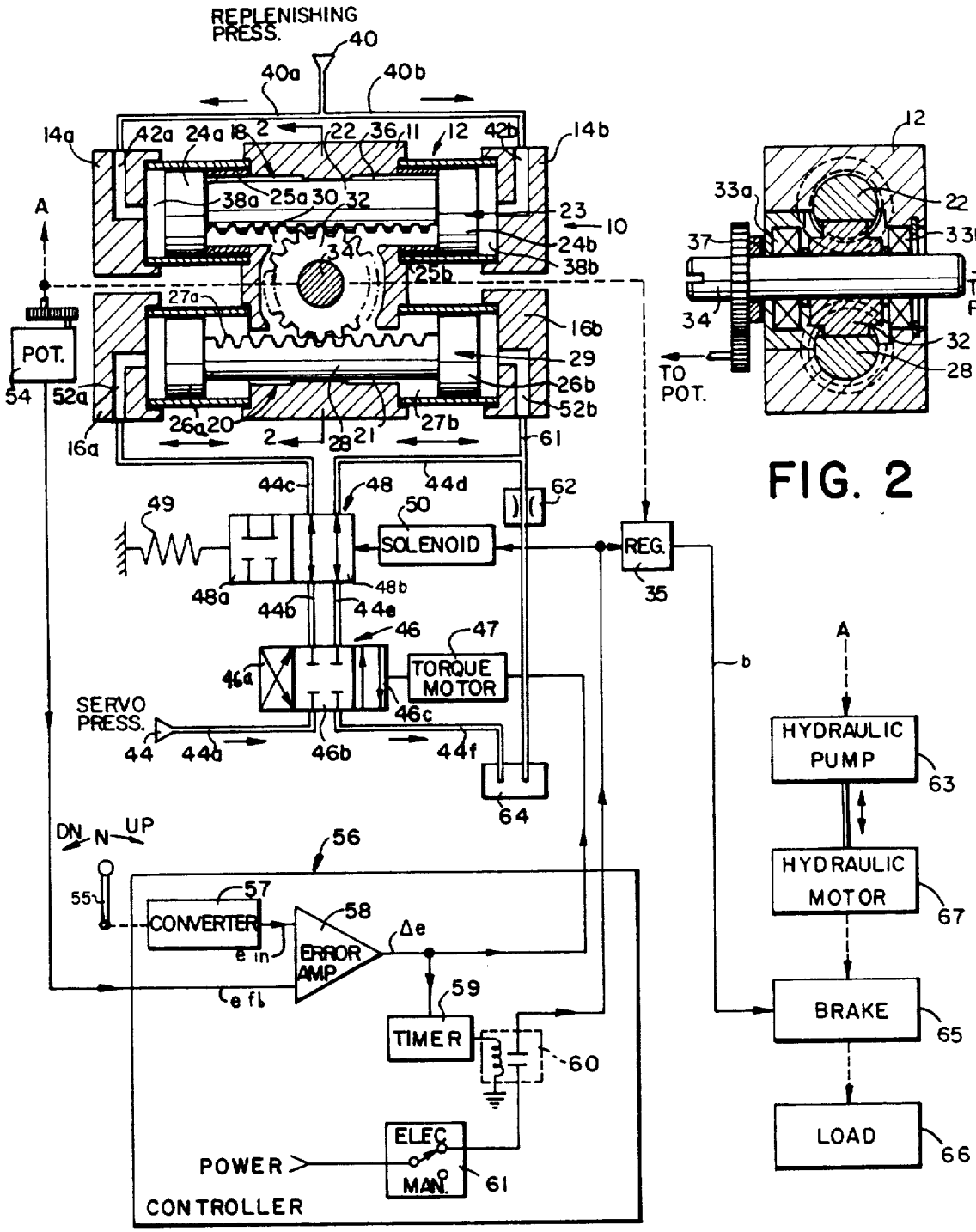
FIG. 1 is a cross-sectional view of a rotary actuator with a schematic diagram of hydraulic and electronic controls of an automatic centering servo actuator according to the invention.
Figure 2:
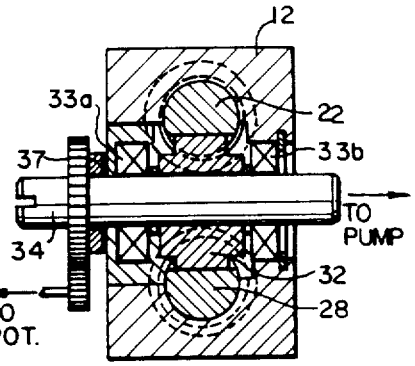
FIG. 2 is a cross-sectional view of the actuator and output shaft along the line 2—2.

Referring to the drawings, a rotary actuator 10 is provided having two pairs of spaced end caps 14*a* and *b* and 16*a* and *b* fixed to a central body 11. Body 11 and the end caps 14 and 16 together define a housing 12 for the rotary actuator 10. Housing 12 includes spaced segmental piston chambers 18 and 20. Chamber 18 as referred to as the centering chamber, while chamber 20 is referred to as the working chamber. A centering piston 23 composed of a central rack portion 22 and spaced end pistons 24*a* and 24*b* is disposed in the centering chamber 18. Stop tubes 25*a* and 25*b* are disposed in centering chamber 18 adjacent to body 11. Stop tube 25*a* prevents end piston 24*a* from traveling past a center position. Stop tube 25*b* prevents end piston 24*b* from traveling past the center position. End pistons 24*a* and 24*b* are not attached to rack 22. Pistons 26*a* and 26*b* are disposed in the working piston chamber 20. A central rack portion 28 is connected between 26*a* and piston 26*b*. A working piston 29 composed of a central rack portion 28 and spaced end pistons 26*a* and 26*b* connected at opposite ends thereof is disposed in the working chamber 20. A gear and lubricant chamber 30 is formed in the center of body 11 and in communication with the centering and working pistons 23 and 29. Bearings 33*a* and *b* are each positioned at opposite ends of chamber 30 to minimize rotational friction and position and journal an output shaft 34 therein. Shaft 34 passes thru and connects to a pinion gear 32. Gear 32 is positioned about shaft 34 and within chamber 30 so that racks 22 and 28 are engaged thereby. The segmental piston chamber 18 includes a cylindrically contoured central bore 36 and cylindrically contoured enlarged, spaced end portions 38*a* and 38*b*. Portions 38*a* and *b* are of equal diameter and in actual alignment with one another and the central portion 36. Piston ends 24*a* and *b* are disposed respectively in the enlarged portion 38*a* and *b*. Portions 38*a* and *b* terminate at the inner walls of end caps 14*a* and *b* respectively acting as stops to limit the outward travel of piston end caps 24*a* and *b*. The inward travel of the piston ends 24*a* and *b* are limited by stop tubes 25*a* and *b* respectively. The segmental working piston chamber 20 includes a cylindrically contoured central bore 21 and enlarged spaced end portions 27*a* and *b*. Portions 27*a* and *b* are of equal diameter and the same as the diameter of the segmental centering chamber 18 spaced end portions 38*a* and *b*. Enlarged portions 27*a* and *b* are in actual alignment with one another and the central portion 21. The piston ends 26*a* and *b* are disposed respectively in the enlarged portions 27*a* and *b*. Portions 27*a* and *b* respectively terminate at the inner walls of end caps 16*a* and *b* acting as stops to limit the outward travel of pistons 26*a* and *b* respectively. The movement of rotary actuator 10 is controlled by two fluid pressure conduction systems. A replenishing port 40 communicates a first hydraulic fluid having a pressure range of 50–200 PSI through tubing 40*a* and *b*, passage 42*a* and *b* of end caps 14*a* and *b* and in one side of piston 24*a* and *b* in the end portions 38*a* and *b* of segmental centering piston chamber 18. A servo pressure inlet port 44 communicates hydraulic fluid having a pressure range of 500–1000 PSI through tubing 44*a* to servo valve 46. Servo valve 46 is composed of three selectable sections 46*a, b* and *c* which can be positioned by a torque motor 47 for providing the input fluid to actuator 10 so that an output shaft 34 in communication therewith may be rotated clockwise or counterclockwise. Valve 46 converts current signals from a remote controller 56 into hydraulic flow to the rotary actuator 10. FIG. 1 illustrates servo valve 46 in the electronic ready mode in which section 46*b* is in position and through which no fluid can flow. A directional valve 48 is connected to receive the input fluid through tubing 44*b* and to pass said fluid to the rotary actuator 10. Valve 48 controls the flow of fluid to the working cylinder by the activation or deactivation of a solenoid 50. As shown in FIG. 1, when solenoid 50 is activated valve 48 is moved into position 48*b* and will permit the fluid to pass through tubing 44*c*, passage 52*a* into one side of actuator 10 and to receive the fluid from the other side of actuator 10. When solenoid 50 is deactivated direction valve 48 will be moved into position 48*a* by spring 49 and open the input fluid flow path and simultaneously short the working cylinder to equalize the pressure. Input passages 52*a* and *b* extend through end caps 16*a* and *b* respectively and are in communication with working cylinder 27*a* and *b*, respectively. Output shaft 34 is connected through mechanical linkage A to control a hydraulic pump 63 of conventional design. A hydraulic motor 67 is connected to receive the fluid flow and to convert same into mechanical energy. A brake 65 is connected to motor 67 to prevent unwanted movement of a load 66. Pump 63, motor 67, brake 65 and load 66 are not part of the invention. Shaft 34 is connected to potentiometer 54 for providing a feedback signal $e_{fb}$ proportional to the angular position of shaft 34. Controller 56 is connected to receive feedback signal $e_{fb}$ and the mechanical position of a control stick 55. A converter 57 within controller 56 converts the mechanical position of control stick 55 to an electrical input signal $e_{in}$. An error amplifier 58 is connected to receive feedback signal $e_{fb}$ and the input signal $e_{in}$ for providing an error signal $\Delta e$ indicative of the difference between signal $e_{in}$ and $e_{fb}$. A timer 59 detects the presence of signal $\Delta e$ and begins to count down a predetermined time period. If signal $\Delta e$ is still present at the end of the period, then timer 59 deenergizes the coil of relay 60 thereby opening the relay contact which deenergizes solenoid 50. Relay 60 is connected to receive current from timer 59 and provide electrical power to engage solenoid 50. Torque motor 47 is connected to receive signal $\Delta e$ and turn in a direction consistent with signal $\Delta e$ so as to slide servo valve 46 to a position which will allow the input fluid to rotate shaft 34 to satisfy requests made from positioning of control stick 55. A switch 61 is connected in an electronic mode to provide power through the contracts of relay 60 to solenoid 50 and to disconnect said electrical power in a manual mode. An orifice 62 is connected to bleed fluid pressure to a tank 64 when directional valve 48 is deenergized and held in position 48*a* by spring 49. In the electronic mode when electric power is lost solenoid 50 disengages and a brake switch 35 provides a braking signal b to brake 65 which then mechanically prevents load 66 from changing position. In manual mode brake switch 35 provides signal b unitl cam 37 operates to release the brake when shaft 34 is manually rotated $\pm 3°$ from a braked position.

Operation of the automatic centering servo actuator is summarized as follows. There are two operating modes, electronic and manual. In manual, controller 56 is not used and pump 63 can be stroked by manually turning shaft 34. In manual mode actuator 10 provides a constant centering force to return the manual servo valve of pump 63 to neutral and is provided with automatic releases of brake 65. Thus, direct operator control of output speed and direction is accomplished. Manual control uses internal hydraulic pressure to center the output shaft. When switch 61 is in the electronic position, the electronic mode is selected and actuator 10 position is determined solely by the position of control stick 55. Actuator output is infinitely variable and proportional to the position of control stick 55. There are two conditions of electronic operation, standby and ready. In standby, actuator 10 is hydraulically centered, as in the manual mode but all methods of releasing the brake 65 are disabled, any accidental movement of either control stick 55 or manual rotation of shaft 34 will not result in load 66 movement. In the ready condition actuator 10 is positioned in response to control stick 55 and overrides manual inputs.

Actuator 10 utilizes two sets of hydraulic cylinders 23 and 29, racks 22 and 28 and a pinion gear 32 to drive an output shaft 34. Centering cylinder 23 utilizes stop tubes 25*a* and *b* to prevent pistons 24*a* and *b* from traveling past the center position. Each piston is therefore able to apply a constant force to center shaft 34. Once rack 22 reaches center the stop tubes absorb the force. The working cylinders do not have stop tubes so the pistons can drive the output shaft throughout the range of travel $\pm 35°$. A directional valve 48 controls the flow of fluid to the working cylinders 29. When deenergized cylinders 29 are bypassed and when energized they are controlled by the electrohydraulic servo valve 46. FIG. 1 is shown in the electronic ready mode. An operator wishing to control the position of a load does so by moving the position of the control sitck 55. The movement sensed by controller 56 which provides an error signal $\Delta e$ to torque motor 47. Torque motor 47 turns servo valve 46 so that section 46*a* is rotated into position allowing the passage of input fluid from servo pressure inlet port 44 through tubing 44*a* through section 46*a* to tubing 44*e*. In the electronic mode, solenoid 50 is energized positioning direction valve 48 so that section 48*b* thereof is in position to pass the fluid from tubing 44*e* through tube 44*d*, end cap passage 52*b* and hence to working pistons chamber 27*b*. Fluid pressure on piston 26*b* forces rack 28 over so that the space between end cap 16*a* and piston 26*a* decreases causing hydraulic fluid previously located in cavity 27*a* to be forced through passage 52*a* through tubing 44*c* through direction valve section 48*b* through tubing 44*b*.

As a result of the movement of rack 28, pinion 32 will rotate in a clockwise direction and shaft 34 will, as a result, rotate. Potentiometer 54 is mechanically connected to shaft 34 and provides a feedback signal $e_{fb}$ to error amp 58. When signals $e_{in}$ and $e_{fb}$ are equal signal $\Delta e$ is nulled to zero and torque motor 47 rotates servo valve 46 to section 46*b*. As a result working cylinder 29 remains in the requested position. In electronic mode it is impossible for the centering cylinder 23 to override the actuator position since there is approximately five times more force available on the working cylinder. Shaft 34 is mechanically connected to a hydraulic pump 63 and therein adjusts a manual servo valve regulating the flow of fluid from the pump. A hydraulic motor 64 is connected to receive the flow of fluid for changing the position of load 66 as originally requested by the movement of control stick 55 by an operator. Movement of control stick 55 in the opposite direction would force controller 56 to provide an error signal Δe of the opposite polarity causing torque motor 47 to turn rotating valve 46 to position 46c. Fluid flowing from input inlet port 44 would then flow through tubing 44a, 44b through direction valve 48 through 44c, through passage 52a into working piston cavity 27a. The increased pressure on piston 26a would force rack 28 in the opposite direction from that previously moved. Hence, load 66 would be moved in the opposite direction. In the electronic mode, brake release 35 prevents brake from being applied. Normal pressure from inlet port 44 is in the range of 500 to 1000 pounds per square inch. This pressure is high enough to overcome replenishment pressure on inlet port 40 which is in the range of 50 to 200 pounds per square inch. Replenishment pressure acts on the pistons to drive the rack 22 and output shaft 34 towards center, with the sides of stop tubes 25a and *b* determining where the physical center will be. In manual mode, power is removed from solenoid 50 deenergizing directional valve 48 so that spring 49 positions directional valve 49 to section 48a. This section short-circuits the working cylinder and allows the orifice 62 to bleed pressure to tank 64. Working cylinder 29 is disabled since no pressure will provide force to move the pistons. In the manual mode replenishment pressure acts on the centering pistons 24a and *b* to drive rack 22 and shaft 34 toward center as determined by the size of stop tubes 25a and *b*. This results in a constant positive centering force whenever the actuator is stroked off neutral. The force is low enough to be overcome by manual rotation of shaft 34.

Therefore, some of the many advantages of the present invention should now be apparent. A rotary actuator for stroking a manual servo valve by remote electrical control for manual commands has been disclosed. The high resolution servo actuator provides increased holding torque in an electronic mode. Furthermore, it provides increased, precise centering torque throughout the rotational range at all times. When utilized in manual the actuator has an automatic brake release. The present invention is reliable in operation, relatively inexpensive to manufacture and easily adapted to incorporate within existing hydraulic pump control systems. Additionally, the present invention provides infinite positioning in any mode.

Obviously, other embodiments and modifications of the present invention will readily come to those ordinarily skilled in the art having the benefits of those teachings presented in the foregoing teachings. It is therefore to be understood that various changes in the details, the materials, steps and arrangement of parts, which have been described and illustrated to explain the nature of the invention, may be made by those skilled in the art within the principle and scope of the invention as expressed in the appended claims.

What is claimed:

1. An automatic centering servo actuator comprising:

a rotatable shaft;

hydraulic centering means for providing a constant centering force to center said shaft, including first and second pistons disposed within a first piston chamber on one side of said shaft, a slidable member disposed between said first and second pistons, stops disposed within the first piston chamber for limiting the inward stroke of said pistons such that each piston is prevented from traveling beyond a position necessary to center the slidable member with respect to the shaft, and a first pressurized source of hydraulic fluid communicating with the first piston chamber for conveying fluid to and from the ends thereof at a constant pressure as said pistons move within the chamber;

hydraulic working means for providing a working force to drive the shaft through its range of travel, including a double-action piston operatively disposed within a second piston chamber on the other side of said shaft from the first piston chamber, a second pressurized source of hydraulic fluid having a pressure range sufficient to overcome the centering force, and flow means connected between said second source and the second piston chamber for directing the fluid to either end thereof; and force transmission means drivingly connecting said hydraulic centering means and said hydraulic working means to said shaft.

2. Apparatus as recited in claim 1 wherein said force transmission means comprises:

a first set of gear teeth disposed on one side of said slidable member;

a second second set of gear teeth disposed on one side of said double-action piston; and a pinion gear connected to said shaft and engaged with said first and second sets of gear teeth, whereby said shaft may be rotated.

3. Apparatus as recited in claim 2 further comprising electrohydraulic control means responsive to a remote control handle and the position of said shaft for controlling the operation of said flow means connected thereto.

4. Apparatus as recited in claim 3 wherein said flow means comprises:

a torque-motor operated, three-position valve, said valve passing the fluid straight through in one position, preventing fluid flow in a second position, and passing fluid crosswise in the third position, such that hydraulic pressure may be selectively applied to either end of the second piston chamber;

a solenoid operated two-position valve operatively connected between said three-position valve and the second piston chamber for allowing hydraulic fluid to flow to the ends of the second piston chamber in one position, and for bypassing fluid between the piston chamber ends in the second position; and an orifice operatively connected to the second piston chamber for bleeding off fluid therefrom when the ends of said piston chamber are bypassed.

5. Apparatus as recited in claim 4 wherein said electrohydraulic control means comprises:

a potentiometer mechanically connected to the rotatable shaft for providing an electrical position signal indicative of shaft position;

an electromechanical converter for changing mechanical movement of the remote control handle into an electrical command signal indicative of a desired shaft position;

an error amplifier for comparing the position signal and the command signal and for generating an error signal when the position signal differs from the command signal, said error signal constituting an actuating signal for said torque-motor operated, three-position valve;

a timer for detecting the presence of the error signal and providing an electric release signal when the error signal is present for longer than a predetermined period; and a relay connected to said timer, said solenoid operated valve, and an electrical power source for permitting said solenoid operated valve to be energized when the release signal is not present, and for deenergizing said solenoid operated valve when the release signal is present.

6. An automatic centering servo mechanism comprising:

a hydraulic actuator of the type having a rotatable shaft journaled in a housing with first and second piston chambers on two sides of the shaft, rack gears disposed between first and second pistons in each piston chamber and engaged with a pinion gear connected to the shaft, and stops disposed within the first piston chamber for limiting the inward stroke of the pistons therein such that each piston is prevented from traveling beyond a position necessary to center the rack with respect to the shaft;

a first pressurized source of hydraulic fluid communicating with the ends of the first piston chamber for conveying fluid to and from the piston chamber ends at a constant pressure as the pistons move within the chamber, such that a constant hydraulic force is applied to the pistons for centering the rack;

a second pressurized source of hydraulic fluid having a pressure range sufficient to overcome the hydraulic centering force;

a torque-motor operated, three-position valve for receiving hydraulic fluid and from said second source, passing the fluid straight through in one position, preventing fluid flow in the second position, and passing fluid crosswise in the third position, such that a hydraulic working force may be applied selectively to either of the pistons in said second piston chamber;

a solenoid-operated, two position valve operatively connected between said three-position valve and the second piston chamber for allowing hydraulic fluid to flow to the ends of the second piston chamber in one position, and for bypassing fluid between the piston chamber ends in the second position;

a potentiometer mechanically connected to the shaft for providing an electrical signal indicative of the shaft position;

an electromechanical converter for changing mechanical movement of a remote control handle into an electrical command signal indicative of a desired shaft position;

an error amplifier for comparing the position signal and the command signal, and for generating an electrical error signal when the compared signals differ, the error signal constituting an actuating signal for said torque-motor operated, three-position valve;

a timer for detecting the error signal and providing an electric release signal when the error signal is present for longer than a predetermined period of time; and a relay connected to said timer, said solenoid-operated two-position valve, and an electrical power source for permitting said solenoid operated valve to be energized when no release signal is present, and for deenergizing said solenoid operated valve when the release signal is present.

* * * * *